US005294109A

United States Patent [19]

Meade

[11] Patent Number: 5,294,109

[45] Date of Patent: Mar. 15, 1994

[54] BALL TOSSING DEVICE FOR BASEBALL BATTING PRACTICE

[76] Inventor: John H. Meade, 5925 Colgate Ave., Los Angeles, Calif. 90036

[21] Appl. No.: 981,798

[22] Filed: Nov. 25, 1992

[51] Int. Cl.[5] ..... A63B 69/40

[52] U.S. Cl. ..... 273/26 D; 273/29 A; 124/54

[58] Field of Search ..... 273/26 R, 26 D, 29 A, 273/201; 124/54, 32

[56] References Cited

U.S. PATENT DOCUMENTS

| | | | |
|---|---|---|---|
| 1,868,261 | 7/1932 | Spencer | 273/201 |
| 1,952,113 | 3/1934 | Beckett | 273/201 |
| 2,127,282 | 8/1938 | Beckett | 273/201 |
| 3,612,027 | 10/1971 | Makino | 273/26 R |
| 3,856,300 | 12/1974 | Payne | 273/26 R |
| 4,021,036 | 5/1977 | Nelson | 273/29 A |
| 4,129,110 | 12/1978 | Kubrak | 273/26 D |
| 4,132,214 | 1/1979 | Schnurr | 273/29 A |
| 4,194,648 | 5/1980 | Stanton | 273/201 |
| 4,865,318 | 9/1989 | Lehmann | 273/26 R |
| 4,946,164 | 8/1990 | Fuller | 273/26 R |
| 5,160,131 | 11/1992 | Leon | 273/26 R |

FOREIGN PATENT DOCUMENTS

| | | | |
|---|---|---|---|
| 525751 | 2/1956 | Canada | 273/201 |
| 2231803 | 11/1990 | United Kingdom | 273/201 |

*Primary Examiner*—Theatrice Brown
*Attorney, Agent, or Firm*—W. Edward Johansen

[57] ABSTRACT

A device for training a hitter to hit a baseball includes a striker rod having a striker head, a solenoid having a plunger, a ramp, a support structure and a control unit. The plunger is coupled to the striker rod. The support structure is coupled to the ramp. The ramp is coupled to the solenoid. The control unit is electrically coupled to the solenoid and activates the solenoid causing the plunger to move upward. When the plunger moves the striker rod upward the striker head propels a baseball upward.

5 Claims, 4 Drawing Sheets

Fig. 4.
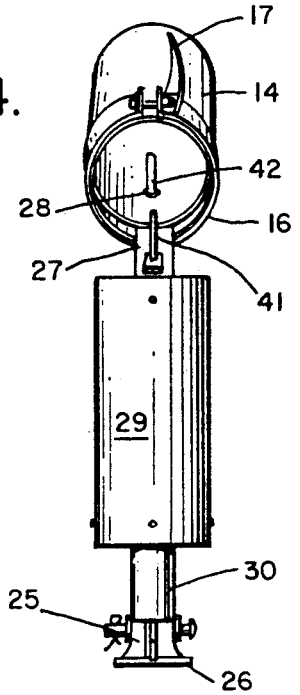
Fig. 5.
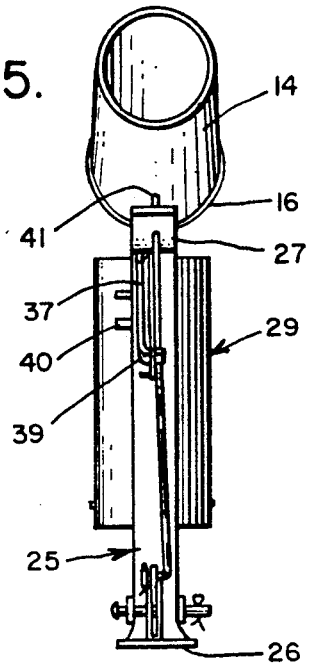
Fig. 6.
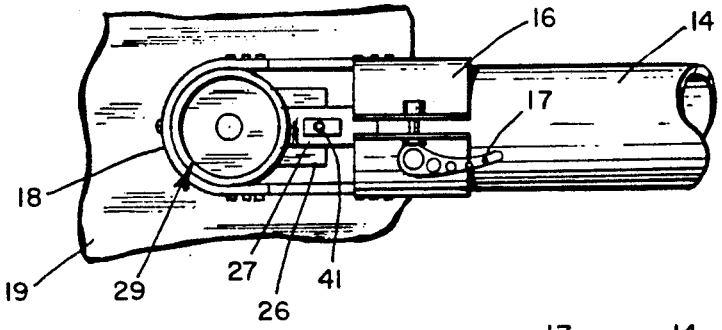
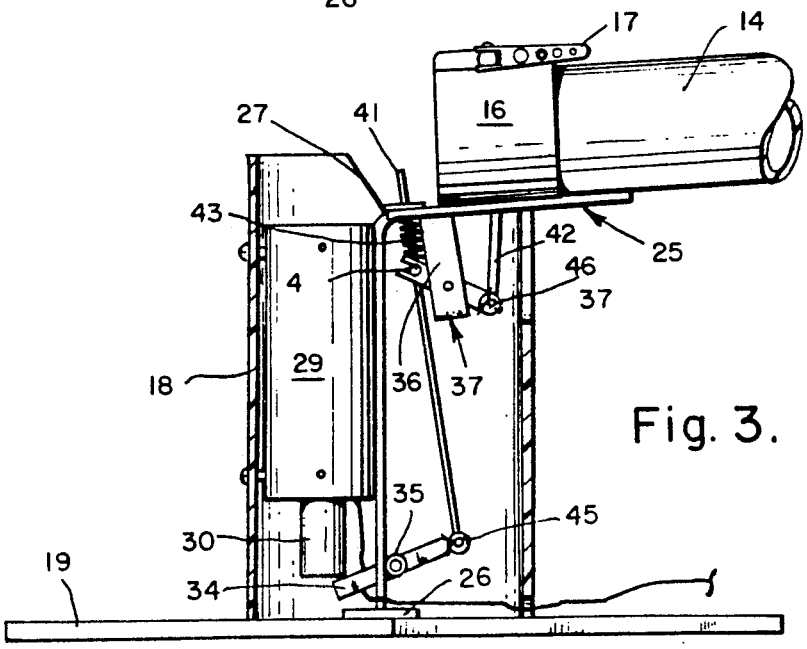
Fig. 3.

BALL TOSSING DEVICE FOR BASEBALL BATTING PRACTICE

BACKGROUND OF THE INVENTION

The field of the invention is devices for training a hitter to hit a baseball.

There are many drills and exercises used to teach the art of hitting a baseball. Common to all teams is a soft toss drill which involves a tosser and a batter. The tosser with a number of baseballs kneels at a distance of three to four feet off to the side of the batter. In order to perform the soft toss drill properly the tosser softly tosses each baseball into an area of the strike zone where the batter has the least proficiency. The batter attempts to make contact with the baseball at the intended point and usually drives the baseball into a nearby backstop. In order to perform the soft toss drill properly the tosser must not fall into a predictable frequency, but must continuously vary both the time between each toss.

This represents the ideal, but, according to knowledgeable coaches, what normally happens is that boredom quickly sets in and chatter inevitably breaks out so that the last thing on the young participants' mind is baseball. The drill for all its potential and intent is rendered useless.

Coaches agree that the greatest learning will be derived from a device for training a hitter to hit a baseball which meets the following four criteria. The first criterion is that the device permit a hitter to practice his hitting without the need of someone else. The second criterion is that the device be small and portable enough so that he can use the device both on the field and at home. The third criterion is that the device incorporate means for controlling both the height and frequency of each toss. The fourth criterion is that the device be repetitive so that the player does not have to break his concentration by having to stop and physically reload the device with a baseball and set the firing system before each hit.

The patents which are cited below teach devices for training a hitter to hit a baseball which meet the first and second criteria in that all of the devices may be operated by a player alone and are small and portable enough to operate in a small area either on the field or at home.

U.S. Pat. No. 4,676,504 teaches a device for training a hitter to hit a baseball which individually tosses a column of baseballs with the manual ability to vary the trajectory of the baseball, but which has no mechanism to vary the frequency of the tosses. U.S. Pat. No. 5,097,985 teaches a device for training a hitter to hit a baseball which controls the frequency of the tosses by means of a motor driven device, but which has no mechanism for varying the trajectory of the baseball. U.S. Pat. Nos. 4,955,606, 4,858,921, 4,865,318 and 4,778,177 all teach devices for training a hitter to hit a baseball which require the interruptive physical action of loading and/or cocking, before the hitter can swing at the baseball.

U.S. Pat. No. 4,676,504 teaches a baseball dispensing apparatus for hitting practice which includes a baseball retainer for retaining and sequentially delivering baseballs to one end thereof, a lever rotatably mounted on a shaft at the one end of the retainer for engaging and lifting a baseball from the retainer upon rotation of the lever, and an actuator for the lever for causing the lever to engage, lift, and project a baseball from the retainer. A spring is attached to the retainer and to the shaft for accelerating the rotation of the lever into engagement with the baseball. The tension of the spring can be varied thereby varying the trajectory of a baseball lifted from the retainer.

U.S. Pat. No. 5,097,985 teaches an automatic baseball delivery system which includes a chute which is generally downwardly-extending and which delivers baseballs by gravity to a hitting area, a dispenser which deposits automatically baseballs into the chute and a support which supports the dispensing tank and the chute.

U.S. Pat. No. 4,955,606 teaches a baseball pitching device which includes a baseball capture cavity bearing a lip member positioned to capture and stabilize a single baseball at that level, an adjustable-height stand, a baseball magazine for containing a plurality of baseballs and a release lever which is coupled to the baseball magazine. Touching the release lever allows another baseball to enter the baseball capture cavity in order to launch the baseball. An initial ramp extends downward and rearward away from the baseball capture cavity, and connects to a final ramp which extends further downward but in the forward longitudinal direction. The final ramp terminates in an upwardly-curved launch ramp extending towards the batter in the front of the apparatus so that the launch ramp is generally beneath the baseball capture cavity. The entire apparatus is supported by U.S. Pat. No. 4,858,921 teaches an improved baseball suspending apparatus which utilizes a dual directional component air stream to support the baseball for striking. The dual directional component air stream allows the baseball to be spun according to the desire of the operator. A baseball may be supported to simulate the certain spins associated with fast ball or curvebaseball pitches thrown by either left or right handed pitchers thereby allowing the batter to experience the manner in which a certain type of pitch will react when struck with a bat.

U.S. Pat. No. 4,865,318 teaches a baseball tossing device which includes a tossing mechanism and a foot pedal assembly which is manually depressible for actuating the tossing mechanism to toss a baseball upwardly into the air so that it can be hit with a bat. The tossing mechanism includes a timer assembly which delays the baseball tossing action of the device by a predetermined delay interval so that a batter can assume a fully ready position before the baseball is tossed into the air.

U.S. Pat. No. 4,778,177 teaches a spring loaded arm mechanism which is incorporated into a baseball home plate support for tossing a regulation or practice baseball, from ground level, upwardly into the batter's strike zone. A baseball launching arm, arm bias spring, arm latch and a release are all arranged in a compact, low profile unit flush with or just slightly protruding above the home plate support. The arm is cocked, using an arm engaging hand tool, by rotating a baseball launching arm end downwardly against the biasing into a latched position. After positioning the baseball, the latch is released, either by the batter or by another via a remotely actuated release, to cause the sprung arm to rotate with great force through a limited arc, propelling the baseball vertically up into the strike zone. A practice device includes a lever arm release actuated by the operator's bat and may further include an elastic baseball return tethering cord having an in-line swivel to relieve line twisting. A game play spring loaded arm mechanism mounts the arm and spring unit below the upper plane of the home plate support which has an opening for receiving and launching the baseball, such that the spring loaded mechanism remains safely out of the way for base running.

U.S. Pat. No. 4,538,810 teaches a baseball dispensing device for practicing batting that includes a three tubular chute for retaining and delivering baseballs to a batter. The center tube contains an electric driven motor which rotates a pair of discs which dispense baseballs at timed intervals releasing them to a central tube established at an incline to allow the dispensed baseball to roll and strike a spring. The weight of the baseball causes the spring to flex and upon reflex propels the baseball upward vertically allowing a batter to swing into the baseball. The center motor driven discs are equipped with a hole which when completing a rotation dispenses baseballs alternately to the delivery chute.

U.S. Pat. No. 3,807,379 teaches an apparatus for serving tennis balls which includes a movable frame assembly, a control unit and an ejecting mechanism which is mounted on the frame assembly for forcibly ejecting the tennis ball in a predetermined direction. The control unit is electrically coupled to the ejecting mechanism.

SUMMARY OF INVENTION

The present invention is directed to a device for training a hitter to hit a baseball including a support structure, a ramp, a launch apparatus and a control unit. The ramp is connected to the support structure. The launch apparatus launches the baseball upward from the device. The control unit is electrically coupled to the launch apparatus.

In a first aspect of the invention the launch apparatus is a solenoid which, when activated by the control unit, upwardly launches a baseball.

In a second aspect of the invention the control unit includes a circuit which controls both the frequency of the tosses and the height of each toss.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWING

FIG. 3 is a side elevational view in cross-section of the launch apparatus of FIG. 1 showing the launch mechanism and the ball release mechanism.

FIG. 4 is a front elevational view of the launch mechanism of FIG. 2.

FIG. 5 is a rear elevational view of the ball release mechanism of FIG. 2.

FIG. 6 is a top plan view of the launch apparatus of FIG. 2.

DESCRIPTION OF THE PREFERRED EMBODIMENT

Figure 1:
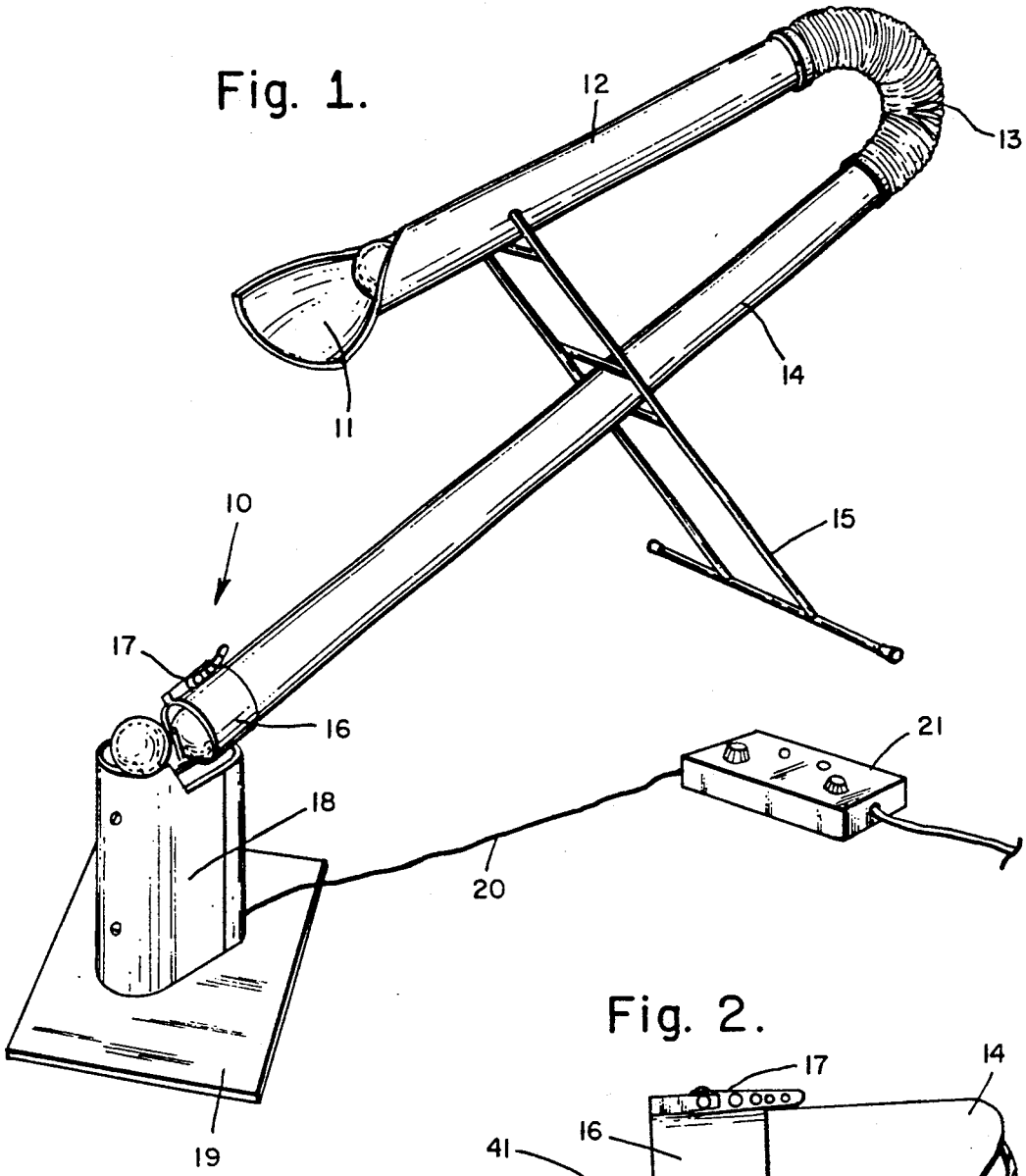
FIG. 1 is a perspective view of a device for training a hitter to hit a baseball including a ramp, a support structure, a launch apparatus and a control unit according to the present invention.

Referring to FIG. 1 a device 10 for training a hitter to hit a baseball includes a hopper 11, a top ramp 12, a ramp connector 13, a bottom ramp 14, a ramp support 15, a connecting collar 16 with a collar closure 17, a launch apparatus 18, a base 19, an electrical connector 20 and a control unit 21. The top ramp 12 is flared open at the first end forming the hopper 11. The hopper 11 facilitates the insertion of a group of baseballs into the top ramp 12. The second end of the top ramp 12 inserts into the first end of the ramp connector 13. Into the second end of the ramp connector 13 is inserted the first end of the bottom ramp 14. The other end of the bottom ramp 14 then inserts into the connecting collar 16 of the launch apparatus 18, being locked in place by the collar closure 17. The ramp support 15 secures the aforementioned structure in such a position as to allow the baseballs to be gravity-fed into the launch apparatus 18.

Figure 2:
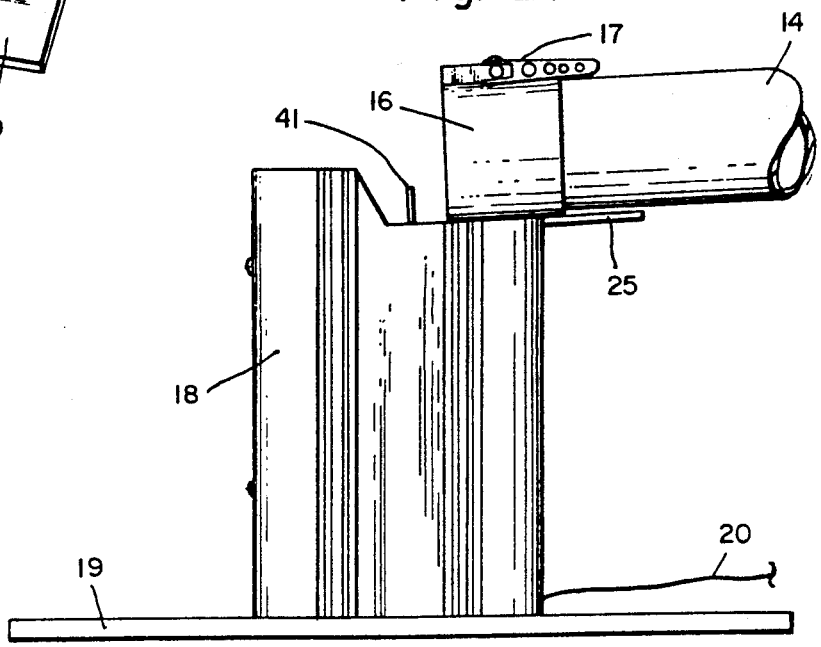
FIG. 2 is a side elevational view of the launch apparatus of FIG. 1 which includes a launch mechanism and a ball release mechanism.

Referring to FIG. 2 in conjunction to FIG. 1 and FIG. 3 the launch apparatus 18 includes a housing 22, a launch mechanism 23, a ball release mechanism 24 and a supporting elbow 25 having a bottom portion, a middle portion, and a top portion. The connecting collar 17 is rigidly attached to the top portion of the supporting elbow 25. The bottom portion of the supporting elbow 25 has a foot 26 which attaches to the base 19. The launch mechanism 23 is coupled to the middle portion of the supporting elbow 25. The top portion of the supporting elbow 25 has a front bore 27 and a rear bore 28.

Referring to FIG. 3 in conjunction with FIG. 4, FIG. 5 and FIG. 6 the launch mechanism 23 includes a solenoid 29 having a plunger 30 and a striker rod 31 having a striker head 32. The plunger 30 is coupled to the striker rod 31. When the plunger 30 moves the striker rod 31 upward the striker head 32 propels a baseball upward. The upper rim 33 of the solenoid 29 functions as a tee in order to support the baseball above so that it is concentrically aligned with the striker head 32 prior to the baseball being launched. The ball release mechanism 24 includes a bottom rocker arm 34, a bottom rocker support 35, a top rocker arm 36 and a top rocker support 37. The bottom rocker arm 34 is a elongated flat rectangular piece of metal which has a first end and a second end with a first bore at the first end and a second bore between the first and second ends. The bottom rocker support 35 is a flange which has a bore and which is rigidly coupled to the supporting elbow 25 superior to the foot 26. A first pin 38 pivotally couples the second bore of the bottom rocker arm 34 to the bore of the bottom rocker support 35. The bottom surface of the plunger 30 is engagingly coupled to the bottom rocker arm 34 adjacent to the second end thereof. The top rocker arm 36 is an elongated flat rectangular piece of metal which has a first end and a second end with a first bore at the first end, a second bore between the first and second ends and a slot at the second end. The top rocker support 37 is an flat elongated rectangular piece of metal having a first end, a second end and a bore. The first end is rigidly fastened to the upper portion of the top rocker support 37 and the second end is bent as to form a stop 39. The bottom rocker support 35 is rigidly coupled to the supporting elbow 25 adjacent to the bottom portion thereof. A second pin 40 pivotally couples the second bore of the top rocker arm 36 to the bore of the top rocker support 37. The ball release mechanism 24 also includes a front stop rod 41, a rear stop rod 42 and a spring 43. The front stop rod 41 has a first end and a second end with a slide pin 44 which is rigidly coupled to the front stop rod 41 between the first and second ends. The slide pin 44 is slidably coupled to the slot of the top rocker arm 36. The spring 43 resiliently couples the front stop rod 41 to the supporting elbow 25. A third pin 45 pivotally couples the first bore of the bottom rocker arm 34 to the front stop rod 41 at the first end thereof. The second end of the front stop rod 41 protrudes through the first bore 27 of the top portion of the supporting elbow 25 in order to hold the first baseball in place within the bottom ramp 14 adjacent to the second open end thereof. The rear stop rod 42 has a first end and a second end. A fourth pin 46 pivotally couples the first bore of the top rocker arm 34 to the rear stop rod 42 at the first end thereof. The second end of the rear stop rod 42 protrudes through the second bore 28 of the top portion of the supporting elbow 25 in order to hold the remainder of the baseballs in place within the bottom ramp 14 behind the first baseball.

Figure 8:
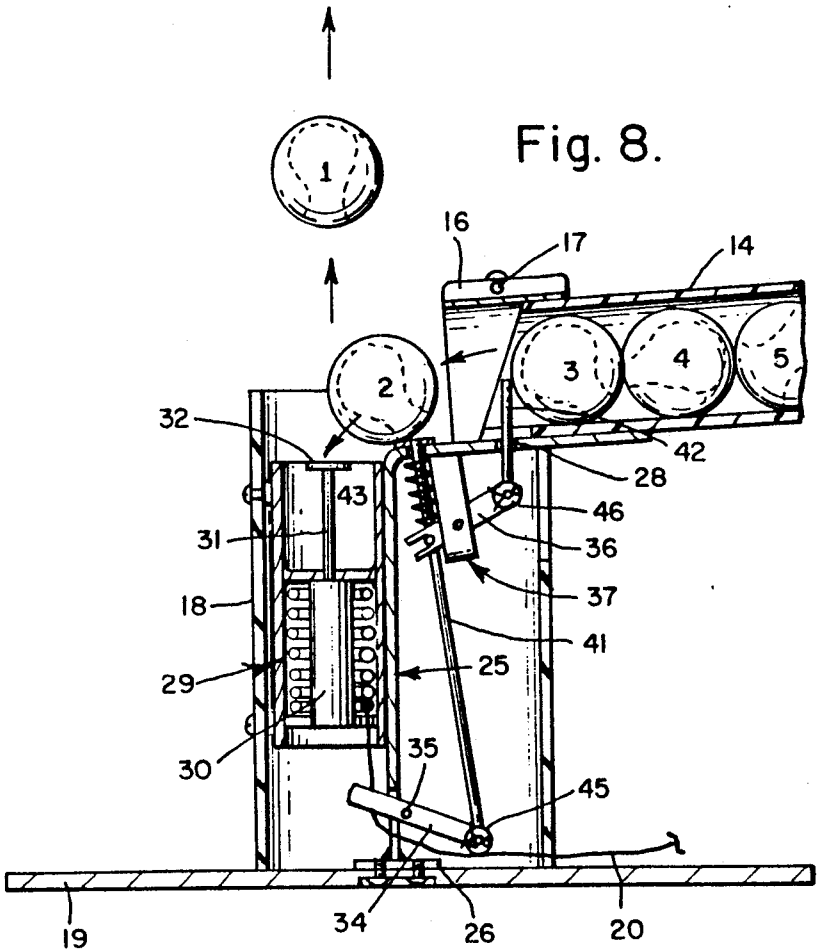
FIG. 8 is a side elevational view in cross-section of the launch apparatus of FIG. 2 showing the state of the launch mechanism and the ball release mechanism immediately following a baseball having been launched.
Figure 7:
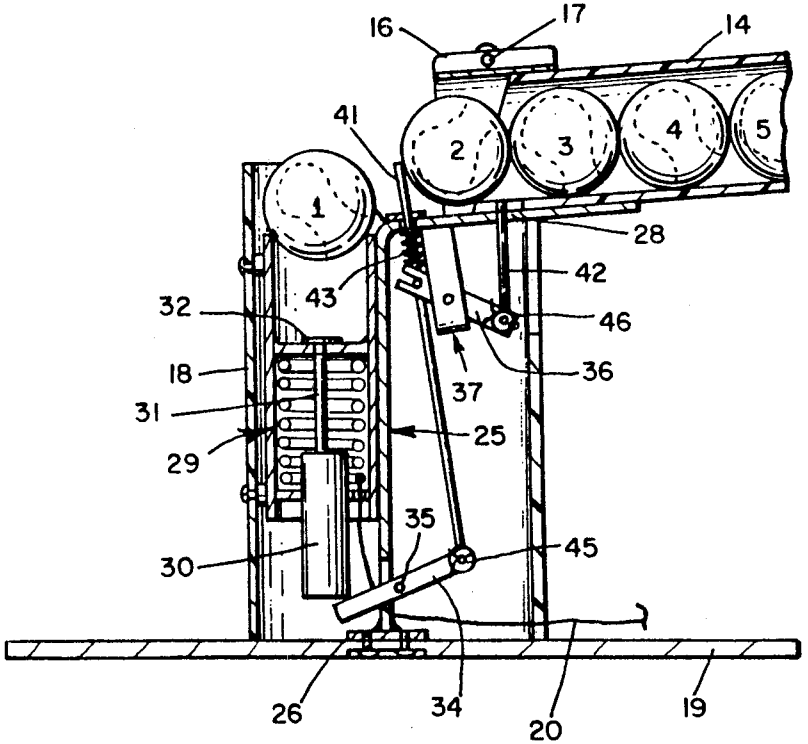
FIG. 7 is a side elevational view in cross-section of the launch apparatus of FIG. 2 showing the launch mechanism and the ball release mechanism at a state of rest just prior to a baseball being launched.

Referring to FIG. 1 in conjunction with FIG. 7 and FIG. 8 the device 10 for training a hitter to hit a baseball operates in the following manner: a group of baseballs is loaded into the hopper 11 rolling down the top and bottom ramps 12 and 14 in single file, until they come to a halt when the first baseball reaches the front stop rod 41. The loading cycle begins when the solenoid 29 is activated by an electric pulse emanating from the control unit 21. The plunger 30 is electro-magnetically drawn up into the solenoid 29, removing the counter force to the spring 43 via the bottom rocker arm 34. The spring 43 forces the front stop rod 42 down, allowing the first baseball to drop onto the rim 33. Simultaneously, the rear stop rod 42 is thrust upward by the teeter-totter action of the top rocker arm 36, thereby preventing the remainder of the baseball column to advance. When the pulse ceases, the plunger 30 drops onto the second end of the bottom rocker arm 34, forcing up the first end thereof and the front stop rod 41 attached to it. The rotation of the top rocker ar 34 is concurrently reversed, pulling down the rear stop rod 42 thereby allowing the baseball column in the top and bottom ramps 12 and 14 to advance one position. With the next pulse the cycle repeats. This time, as the plunger 30 rises, the striker head 32 collides with the baseball positioned on the rim 33 causing the baseball to be launched. The cycles repeat until the last baseball is launched and the control unit 2 is manually turned off.

Figure 9:
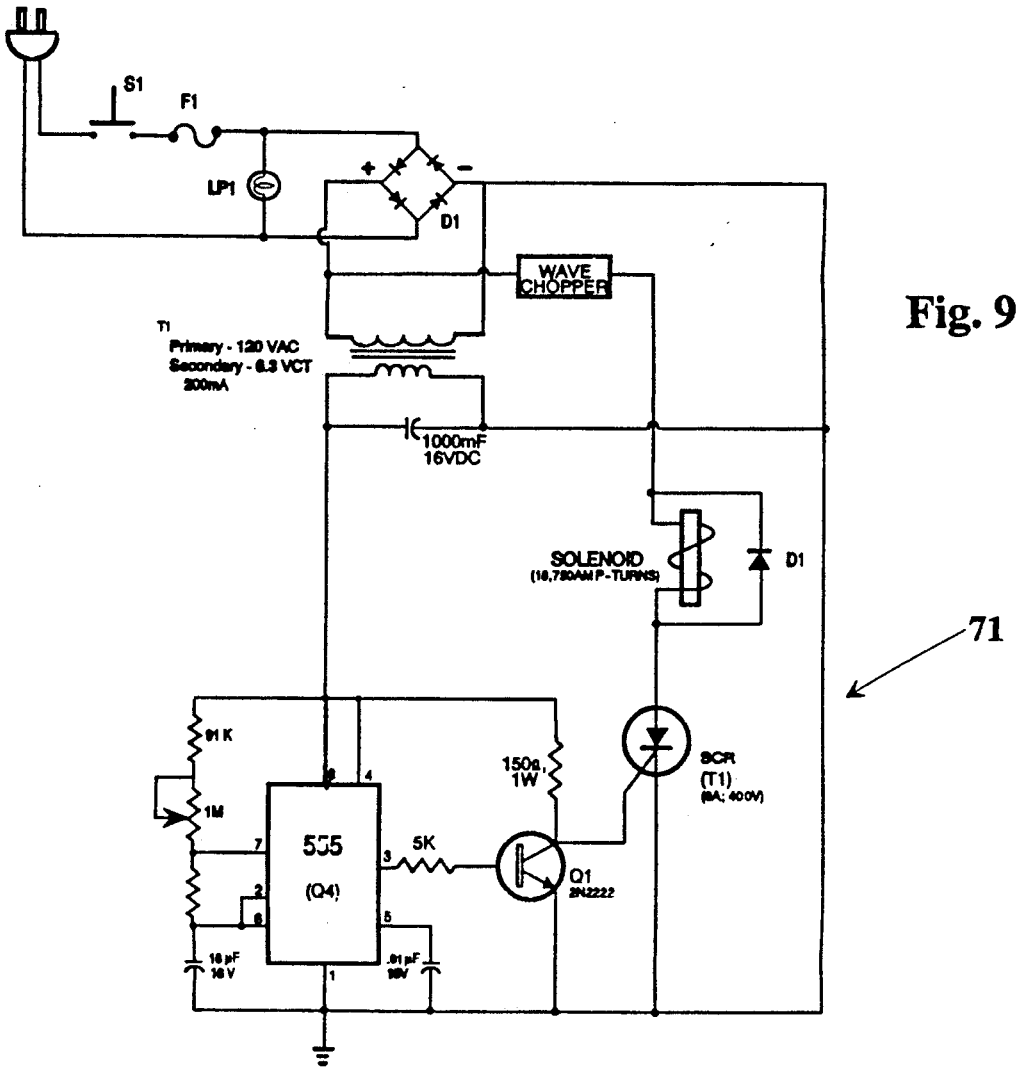
FIG. 9 is a schematic drawing of a timing circuit of the control unit of FIG. 1.
Figure 10:
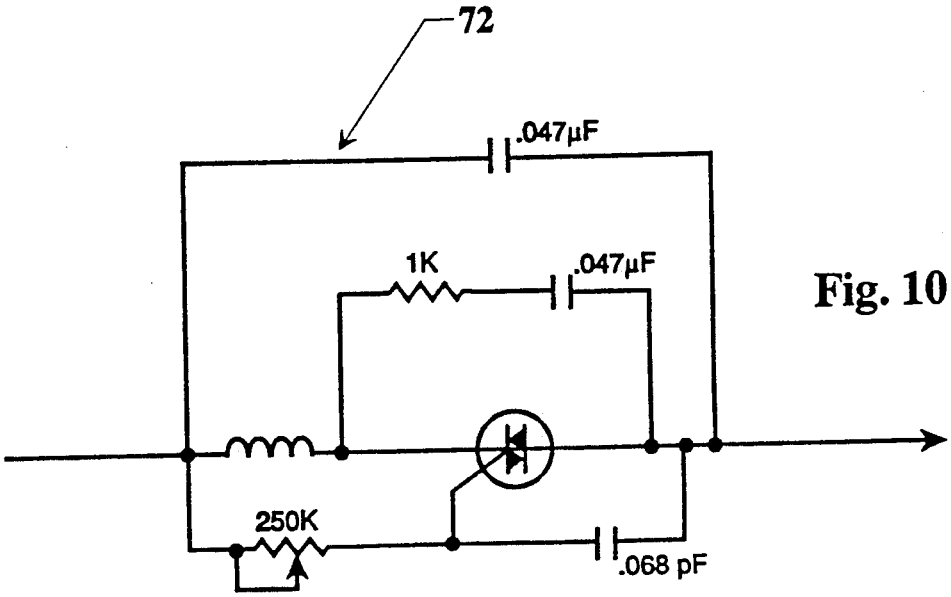
FIG. 10 is a schematic drawing of a height control circuit of the control unit of FIG. 1.

Referring to FIG. 9 and FIG. 10 in conjunction with FIG. 1, the control unit 21 includes a timing circuit 47 and a a height control circuit 48. The timing circuit 47 may incorporate random selector for generating timing and height patterns. The purpose of the timing and a height control circuits 47 and 48 is to control both the height of each launch and the frequency of the launches.

From the foregoing it can be seen that a device for training a hitter to hit a baseball has been described. The device includes a support structure, a ramp, a launch apparatus and a control unit. The launch apparatus is a solenoid which, when activated by the control unit, upwardly launches a baseball. The device permits a player to practice his hitting without the need of someone else and is small and portable enough so that the hitter can use the device both on the field and at home. The control unit includes a circuit which controls the frequency of tosses and the height of each toss and is repetitive so that the player does not have to break his concentration by having to stop an physically reload the device with a baseball and set the firing mechanism before each hit. It should be noted that the sketches are not drawn to scale and that distance of an between the figures are not to be considered significant.

Accordingly, it is intended that the foregoing disclosure and showing made in the drawing shall be considered only as a illustration of the principle of the present invention.

What is claimed is:

1. A device for use in tossing upward a baseball for a hitter to hit, said device comprising:

a. a solenoid cylinder having an upper rim for supporting the baseball, said solenoid having a coil disposed in said cylinder, said upper rim being disposed in a substantially horizontal plane and having an internal diameter less than the diameter of a regulation baseball;

b. a plunger disposed in said cylinder and concentrically aligned with said coil and said upper rim, said plunger having a ball contact end space from said plane and a ball when placed on said rim and being electromagnetically coupled to said coil so that when said coil is electrically energized said coil moves said plunger upward to propel a baseball upward and said control unit further include electrical energy generating means and means for randomly selecting height and frequency patterns at which a ball is launched.

2. A device for use in tossing upward a baseball for a hitter to hit according to claim 1 wherein said device includes:

a. a first ramp attached to said cylinder by support adjacent to said upper rim;

b. a control unit for actuating said solenoid.

3. A device for use in tossing upward a baseball for a hitter to hit according to claim 2 wherein said first ramp has a first open end and a second open end;

a. a ramp connector having a first open end and a second open end, said first open end of said ramp connector being attached to said second open end of said first ramp;

b. a second ramp having a first open end and a second open end, said first open end of the second ramp being attached to said second open end of said ramp connector; and c. a hopper said second open end of said second ramp defining whereby a user may feed baseballs into said second open end of said second ramp.

4. A device for use in tossing upward a baseball for a hitter to hit according to claim 3 wherein said device further includes:

a. a support having a bottom portion, a middle portion and a top portion, said bottom portion having a foot attached to the base and cylinder being attached to said middle portion of said support; and b. a ball release mechanism attached to said top portion of said support.

5. A device for use in tossing upward a baseball for a hitter to hit, said device comprising:

a. a solenoid mounted in a vertically extending a cylinder having an upper rim, said upper rim being disposed in a substantially horizontal plane and having a diameter less than the diameter of a regulation baseball, a coil disposed in said cylinder and solenoid, said solenoid further having a plunger disposed therein, said plunger having a top end and a bottom end and being electromagnetically coupled to said coil whereby when said coil is electrically energized said plunger moves upwardly; biasing means in said solenoid for urging said plunger downwards;

b. a striker rod having one end attached to said plunger top end and its other end having a striker head, said striker head being spaced from said plane and being concentrically aligned with said upper rim, said rim supported a baseball above said striker head, said striker rod fixedly attached to said plunger so that said plunger moves said striker head upwardly to propel a baseball upwardly;

c. a first ramp having a first open end and a second open end, said first ramp first open end being attached to said cylinder adjacent to said upper rim;

d. a support structure attached to said first ramp;

e. a ramp connector having a first open end and a second open end, said first open end of said ramp connector being attached to said second open end of said first ramp;

f. a second ramp having a first open end and a second open end, said first open end of the second ramp being attached to said second open end of said ramp connector;

g. a hopper having a first open end and a second open end, said first open end of said hopper being attached to said second open end of said second ramp whereby a user may feed baseballs into said second open end of said hopper;

h. a base;

i. a support having a bottom portion, a middle portion and a top portion, said bottom portion having a foot attached to said base, said solenoid being attached to said middle portion of said support;

j. a ball release mechanism attached to said top portion of said support, said ball release mechanism including:

a. a bottom rocker arm defined by a first elongated flat rectangular piece of metal, said piece of metal having a first end and a second end, and further having a first bore at said first end and a second bore between the first and second ends;

b. a first rocker support flange having a bore and being rigidly attached to said support adjacent to said foot;

c. a pin extending through said bottom rocker arm second bore and said first rocker support flange bore to thereby pivotally attach said first rocker arm to said first rocker support such that said bottom end of said plunger will engage said bottom rocker arm adjacent to said second end thereof when said coil is deenergized and said plunger is moved downwards by said biasing means;

d. a top rocker arm defined by an elongated flat rectangular piece of metal having a first end and a second end, said rocker arm further having a first bore at said first end, a second bore between said first and second ends and a slot at said second end;

e. a second rocker support having a pair of flanges, each said flange has a bore and is rigidly attached to said support adjacent to said top portion thereof;

f. a first pin extending through said second bore of said top rocker arm and said bore of said second rocker support to pivotally attached said top rocker arm to said second rocker support;

g. a front stop rod having a first end and second end, attachment means intermediate said first and second ends of said front stop rod and slidably engaged with said slot of said top rocker arm, said front stop rod second end slidally extending through a first opening in said first ramp between said first end and said attachment means;

h. a spring, said spring extending between said support structure and said second end of said top rocker arm to urge said second end of said top rocker arm away from said first open end of said first ramp to release a single ball onto said rim;

i. a second pin extending through said first bore of said bottom rocker arm for pivotally connecting said bottom rocker arm to said front stop rod said second end of said front stop rod protrudes through said opening in said support structure in order to hold a first baseball in place within said first ramp adjacent to said first open end thereof;

j. a back stop rod having a first end and a second end;

k. a third pin extending through said first bore of said top rocker arm and pivotally attaching said top rocker arm to said back stop rod at said first end, said second end of said back stop rod protrudes extending through a second opening in said first ramp in order to hold a plurality of baseballs in place within said first ramp. behind a first baseball; said front and back stop rods being spaced apart a distance greater than the diameter of a regulation baseball and k. a control unit for actuating said solenoid.

* * * * *